US006467406B1

(12) United States Patent
Kawabe

(10) Patent No.: US 6,467,406 B1
(45) Date of Patent: Oct. 22, 2002

(54) STENCIL PRINTING MACHINE

(75) Inventor: Takao Kawabe, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 18 days.

(21) Appl. No.: 09/698,148

(22) Filed: Oct. 30, 2000

(30) Foreign Application Priority Data

Nov. 2, 1999 (JP) ..... 11-312584

(51) Int. Cl.[7] ..... B41L 13/04
(52) U.S. Cl. ..... 101/116; 101/DIG. 36
(58) Field of Search ..... 101/114, 116, 101/119, 123, 124, 129, 382.1, 383, 415.1, DIG. 36, 485, 486

(56) References Cited

U.S. PATENT DOCUMENTS 3,311,052 A 3/1967 Zeuthen et al.
4,785,736 A * 11/1988 Jeschke ..... 101/415.1
4,862,800 A * 9/1989 Wieland et al. ..... 101/415.1
5,189,958 A * 3/1993 Tafel et al. ..... 101/415.1
5,440,984 A * 8/1995 Becker ..... 101/382.1
5,660,107 A 8/1997 Takahashi et al.

FOREIGN PATENT DOCUMENTS

DE 476 600 5/1929
DE 893343 * 10/1953
JP 06-344648 * 12/1994

* cited by examiner

*Primary Examiner*—Ren Yan
(74) *Attorney, Agent, or Firm*—Kanesaka & Takeuchi

(57) ABSTRACT

A stencil printing machine includes a base member having rigidity and rotated around a central axis line of its own, and an ink-permeable member having one end portion and the other end portion with respect to a rotational direction of the base member. The ink-permeable member is mounted to the base member along the rotational direction and forms a circumferential surface for attaching a stencil sheet. A skew adjusting device is provided for moving the ink-permeable member relative to the base member in a skewed direction which is not parallel with both of the central axis line and the rotational direction.

10 Claims, 12 Drawing Sheets

STENCIL PRINTING MACHINE

BACKGROUND OF THE INVENTION

1. Field of the Invention

The present invention relates to a stencil printing machine having a printing drum in a cylindrical shape in which perforated stencil sheet is made to wrap on an outer circumferential surface thereof and which is driven to rotate.

2. Description of the Related Art

There has been known a stencil printing machine having a printing drum in a cylindrical shape. An explanation will be given of an example of a structure of the stencil printing machine. The printing drum of the stencil printing machine is provided with a porous and cylindrical supporting member and a mesh screen layer which is made to wrap on an outer circumferential surface of the supporting member. At an inner portion of the printing drum, there is provided ink supplying means for supplying ink onto an inner circumferential face of the printing drum. On an outer side of the printing drum, there is provided a press roller as pressing means in proximity to the printing drum. Stencil sheet is made to wrap on an outer circumferential surface of the printing drum. The printing drum and the pressing means are rotated and print sheet is supplied therebetween. Ink supplied to the inner circumferential face of the printing drum, is transcribed onto the print sheet after passing through opening portions of the supporting member, the mesh screen layer and perforations of the stencil sheet to thereby form an image.

According to the above-described machine, prior to printing operation, a reading apparatus reads image of original and converts the image into electric signals. In accordance with the signals, a stencil making apparatus having a heat generating element such as a thermal head or the like perforates the stencil sheet. Further, the perforated stencil sheet is made to wrap on the outer circumferential surface of the printing drum and thereafter, the printing operation is carried out as described above.

According to the above-described machine, generally, when there causes a shift between printed image and draft image, there is carried out image adjustment in the longitudinal direction and the lateral direction.

Correction of image shift in the longitudinal direction is disclosed in Japanese Patent Laid-Open No. 66308/1975. Correction of image shift in the horizontal direction (lateral direction) is disclosed in Japanese Patent Laid-Open No. 218435/1988.

Further, in an offset printing machine, an aluminum plate is used as a printing plate. The aluminum plate is used by fixing a front end portion thereof by a clamp apparatus and making the aluminum plate wrap on a plate cylinder. A used aluminum plate is provided with considerable strength. All of the face of the aluminum plate is not fixed by the plate cylinder. Hence, in order to adjust a shift of the printed image, the aluminum plate is directly moved by a meandering adjusting member by pivoting the clamp apparatus holding a front end portion of the aluminum plate or moving the aluminum plate in a circular arc shape or the like.

However, according to the above-described conventional stencil printing machine, there poses a problem in which although image shift in the longitudinal direction or the lateral direction can be adjusted, image shift in a skewed direction cannot be adjusted. Further, when the structure of the offset printing machine is applied to the stencil printing machine, the strength of the stencil sheet is extremely smaller than that of the aluminum plate and therefore, there causes a problem in which wrinkle is formed in the stencil sheet or the like.

Japanese Patent Laid-Open No. 344648/1994 discloses a technology for carrying out skew adjustment of image by twisting a printing drum on which stencil sheet is made to wrap. However, strength of the printing drum is small since there are formed a number of perforations for passing ink at a portion of a peripheral wall thereof. Therefore, when the printing drum is twisted as described above, unreasonable stress is generated in the printing drum and there causes a problem of destruction or the like.

According to the present invention, the above-described problem is alleviated and image skew adjustment is carried out simply and without generating unreasonable stress in the printing drum.

SUMMARY OF THE INVENTION

According to a first aspect of the present invention, there is provided a stencil printing machine comprising a base member (15) having rigidity and rotated around a central axis line of its own, an ink-permeable member (2) mounted to the base member along a rotational direction and forming a circumferential surface for attaching stencil sheet, and skew adjusting means (30, 40) for moving the ink-permeable member relative to the base member in a skewed direction which is not in parallel with both of the central axis line and the rotational direction.

According to a second aspect of the present invention, there is provided a stencil printing machine according to the first aspect, wherein the skew adjusting means (30, 40) moves a side of one end portion of the ink-permeable member (2) in the skewed direction.

According to a third aspect of the present invention, there is provided a stencil printing machine according to the second aspect, wherein the ink-permeable member is pivotable relative to the base member (15) centering on a substantially central portion in the central axis line direction at one end side of the ink-permeable member (2).

According to a fourth aspect of the present invention, there is provided a stencil printing machine according to the third aspect, wherein a side of the other end portion of the ink-permeable member (2) is made movable relative to the central axis line.

According to a fifth aspect of the present invention according to the first aspect, there is provided a stencil printing machine, wherein the skew adjusting means (30, 40) moves the side of the one end portion and a side of the other end portion of the ink-permeable member (2) in the skewed direction in cooperation with each other.

According to a sixth aspect of the present invention, there is provided a stencil printing machine comprising, a pair of circular plate members (16) arranged coaxially on a common central axis line and a base member (15) having a first base member (connecting base plate 17) for connecting the pair of circular plate members and rotated around the central axis line. Next, the stencil printing machine is further provided with a second base member (clamping base plate 18) attached pivotally to the first member, clamping means (3) provided to the second base member, and an ink-permeable member (2). The ink-permeable member is provided with one end portion attached to one end portion of the second base member, a pair of side edge portions which are made to wrap on the pair of circular plate members along a rotational direction of the base member and the other end portion attached to the other end portion of the second base member, to thereby form a circumferential surface for attaching stencil sheet, one end portion of which is fixed to the clamping means. Further, the stencil printing machine is provided with skew adjusting means (30) provided to the circular plate member for moving the ink-permeable member in a skewed direction which is not in parallel with both of the central axis line and the rotational direction by pivoting the second base member relative to the first base member.

According to a seventh aspect of the present invention, there is provided a stencil printing machine according to the sixth aspect further comprising an engaging portion (25) formed at the other end portion of the second base member (clamp base plate 18), an elastic member (spring 34) for connecting the other end portion of the ink-permeable member (2) to the engaging portion, wherein when the second base member is moved in the skewed direction by the skew adjusting means (30), a side of the other end portion of the ink-permeable member is moved relative to the central axis line.

According to an eighth aspect of the present invention, there is provided a stencil printing machine comprising a pair of circular plate members (41) arranged coaxially on a common central axis line and a base member (15) having a first base member (connecting base plate 17) for connecting the pair of circular plate members and rotated around the central axis line. Next, the stencil printing machine is provided with a second base member (clamp base plate 18) attached pivotally to the first member, clamping means (3) provided to the second base member, and an ink-permeable member (2). The ink-permeable member is provided with one end portion attached to one end portion of the second base member, a pair of side edge portions which are made to wrap on the pair of circular plate members along a rotational direction of the base member and the other end portion attached to the other end portion of the second base member, to thereby form a circumferential surface for attaching stencil sheet, one end portion of which is fixed to the clamping means. Further, the stencil printing machine is provided with skew adjusting means (40) having a moving member (43) provided to the circular plate member to be pivotable around the central axis line and connected with a side edge portion of the second base member for moving the ink-permeable member in a skewed direction which is not in parallel with both of the central axis line and the rotational direction by pivoting the second base member relative to the first base member by moving the moving member.

According to a ninth aspect of the present invention, there is provided a stencil printing machine according to the eighth aspect, further comprising a first gear portion (51) formed at the other end portion of the second base member (clamping base plate 18), and a second gear portion (52) provided on a side of the other end portion of the ink-permeable member (2) and engaged with the first gear portion (52), wherein when the second base member is moved in the skewed direction by the skew adjusting means (40), the side of the other end portion of the ink-permeable member is moved in the skewed direction.

According to a tenth aspect of the present invention, there is provided a stencil printing machine comprising a base member in a cylindrical shape having a rigid peripheral wall having an ink-permeable opening area and rotated around a central axis line of its own, an ink-permeable member mounted to an outer circumferential surface of a peripheral wall of the base member along a rotational direction of the base member and attached with stencil sheet, and skew adjusting means for moving the ink-permeable member relative to the base member in a skewed direction which is not in parallel with both of the central axis line and the rotational direction.

DETAILED DESCRIPTION OF PREFERRED EMBODIMENTS

An explanation will be given of a first example of an embodiment according to the present invention in reference to FIG. 1 through FIG. 5 and FIG. 12.

Figure 12:
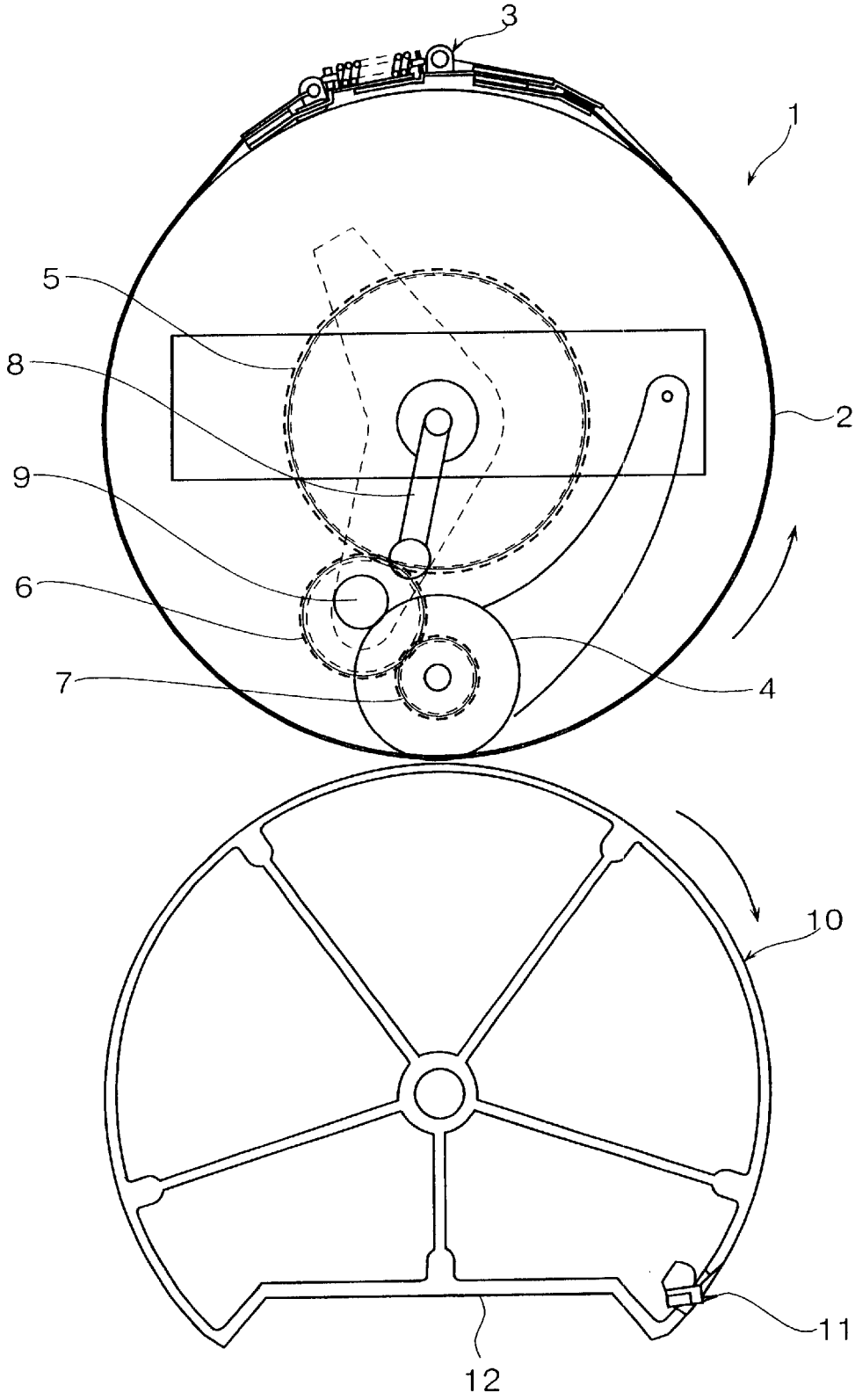
FIG. 12 is a view showing a total constitution of the examples according to the present invention.

As shown by FIG. 12, a stencil printing machine according to the example is provided with a printing drum 1. The printing drum 1 is driven to rotate around a central axis line of its own. A circumferential surface of the printing drum 1 is constituted by an ink-permeable member 2 which is ink-permeable and flexible and is elastically deformed outwardly when depressed from an inner side thereof. At the outer peripheral surface of the printing drum 1, there is provided clamping means 3. Perforated stencil sheet is held by the clamping means 3 at its front end and is made to wrap on the outer circumferential surface of the ink-permeable member 2. At an inner portion of the printing drum 1, there is provided a squeegee roller 4 liftably. The squeegee roller 4 is lowered at a predetermined timing in synchronism with rotation of the printing drum 1 and presses the ink-permeable member 2 outwardly. The squeegee roller 4 is driven to rotate in a direction same as that of the printing drum 1 in cooperation with the printing drum 1 by a drive gear 5 of the printing drum 1, an intermediate gear 6 and a gear 7 of the squeegee roller 4. A doctor roller 9 is arranged to be spaced apart from the squeegee roller 4 by a predetermined interval. Ink is supplied to the inner portion of the printing drum 1 by an ink supply pipe 8 and a constant amount of ink is supplied to a circumferential surface of the squeegee roller 4 by the doctor roller 9.

A pressure drum 10 is arranged on the lower side of the printing drum 1. The diameter of the pressure drum 10 is substantially the same as the diameter of the printing drum 1. In a nonprinting state, there is provided a very small clearance between the printing drum 1 and pressure drum 10. The pressure drum 10 is driven to rotate in a direction reverse to the direction of the printing drum 1 in synchronism with the rotation of the printing drum 1. At an outer peripheral surface of the pressure drum 10, there is provided a hold claw 11 for holding a front end of print sheet openably and closably. At the outer circumferential surface of the pressure drum 10, there is provided a recess portion 12 to evade interference with the clamping means 3 of the printing drum 1.

The front end of supplied print sheet is held by the hold claw 11 of the pressure drum 10. Print sheet is carried in accordance with the rotation of the pressure drum 10. The printing drum 1 is rotated in synchronism with the pressure drum 10. The squeegee roller 4 is lowered at a predetermined timing to thereby press the ink-permeable member 2 outwardly. The ink-permeable member 2 and stencil sheet which are deformed outwardly, sandwich the print sheet between the pressure drum 10 and the ink-permeable member 2 as well as the stencil sheet. The print sheet is carried while being sandwiched between the deformed printing drum 1 and the pressure drum 10. While carrying the print sheet, ink supplied to the inner peripheral face of the ink-permeable member 2, passes through the ink-permeable member 2 and perforations of the stencil sheet and is transcribed onto the print sheet to thereby form an image in correspondence with perforated image of the stencil sheet.

Next, a further detailed explanation will be given of the structure of the printing drum 1 according to the example in reference to FIG. 1 through FIG. 4 and FIG. 12 as follows.

The printing drum 1 is provided with a base member 15. The base member 15 is provided with a pair of circular plate members 16 coaxially arranged on a common central axis line and a connecting base plate 17 as a first member for connecting the pair of circular plate members 16. A longitudinal direction of the connecting base plate 17 is in parallel with the central axis line of the circular plate member 16. The base member 15 is driven to rotate around the central axis line by driving means, not illustrated.

Figure 1:
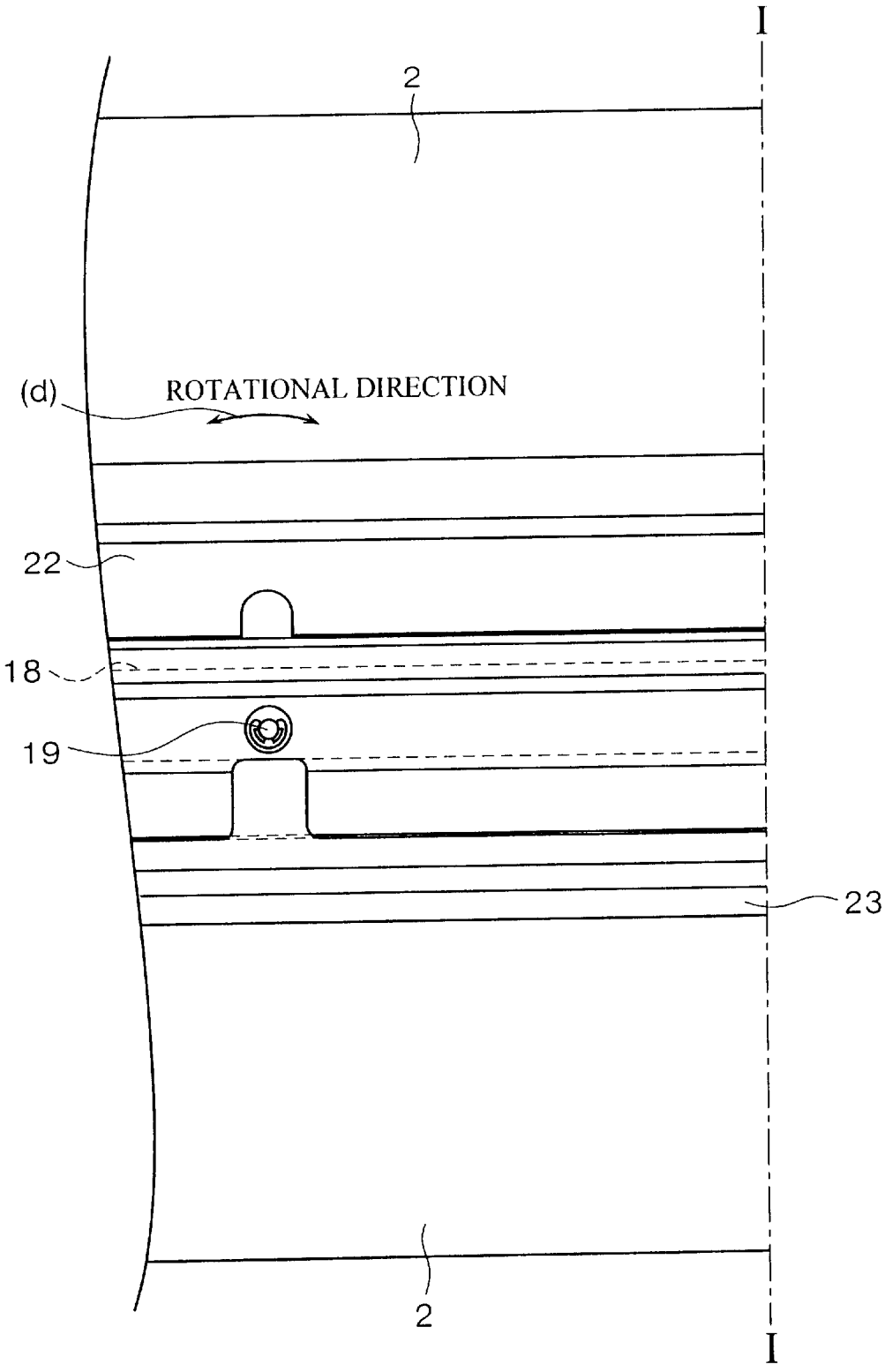
FIG. 1 shows a substantially central portion of a plan view of a first example according to the present invention.
Figure 2:
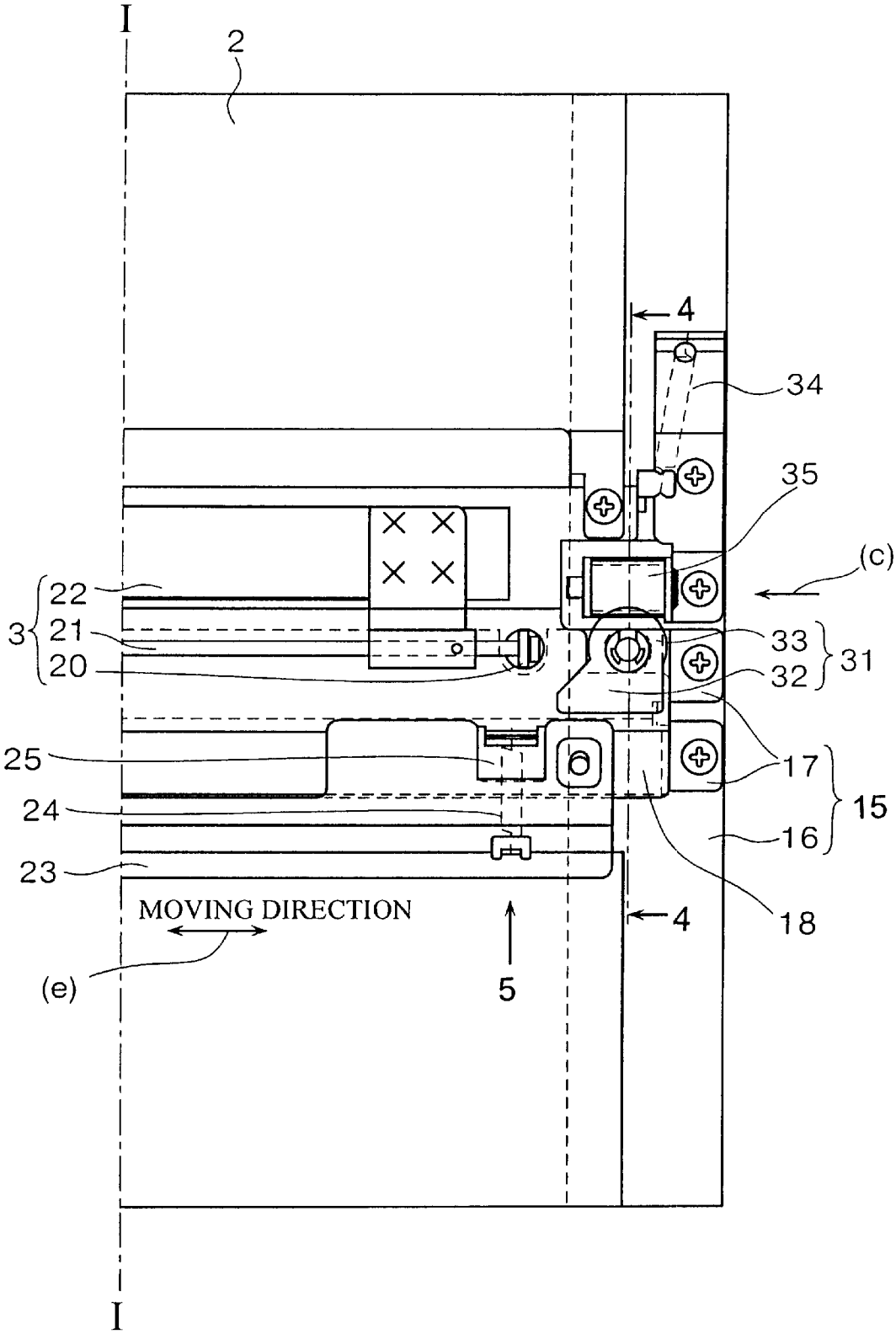
FIG. 2 shows a right half portion of the plan view of the first example according to the present invention.

As shown by FIG. 1 and FIG. 2, the connecting base plate 17 is rotatably attached with a clamp base plate 18 as a second member. According to the example, a substantially central portion of the clamp base plate 18 with respect to the axis line direction of the base member 15, is pivotally connected to a substantially center portion of the connecting base plate 17 by a fulcrum shaft 19. A position of connecting the two base plates 17 and 18 may not necessarily be disposed at the substantially central portion.

The clamp base plate 18 is provided with the clamping means 3. The clamping means 3 is provided with a rotation fulcrum 20 attached to the clamp base plate 18, a rotating shaft 21 pivotally supported by the rotation fulcrum 20 and a clamp plate 22 made of metal attached to the rotating shaft 21. The rotating shaft 21 is in parallel with the central axis line of the base member 15. The rotating shaft 21 is pivoted by a drive mechanism, not illustrated. At an upper face of the clamp base plate 18, there is provided a clamp base having magnetism on one side of the rotating shaft 21. The clamp base plate 22 is magnetically attached to the clamp base while pinching the front end of the stencil sheet to thereby fix the front end of the stencil sheet to the clamp base plate 18. The clamp base plate 22 made of metal strongly holds the stencil sheet by magnetic force.

As shown by FIG. 2, one end portion of the clamp base plate 18 is attached with one end portion of the ink-permeable member 2. The one end portion of the ink-permeable member 2 is on the upstream side in the rotational direction of the printing drum 1. At least a portion of the ink-permeable member 2 is constituted by a material which is ink-permeable and flexible. The ink-permeable member 2 is made to wrap on the base member 15 such that a pair of side edge portions thereof are brought into slidable contact with the circumferential surfaces of the pair of circular plate members 16. Other end portion of the ink-permeable member 2 is fixed with a connecting plate 23 which is slender in the axis line direction. The other end portion of the ink-permeable member 2 is disposed on the downstream side in the rotational direction of the printing drum 1. The connecting plate 23 is attached to the other end portion of the clamp base plate 18 via a spring 24 which is an elastic member. In this way, the ink-permeable member 2 is pulled to the downstream side in the rotational direction by elastic force of the spring 24 and is made to wrap on the circumferential surfaces of the pair of circular plate members 16. Therefore, the ink-permeable member 2 constitutes a cylindrical shape as a whole. When the ink-permeable member 2 is depressed from the inner side, the ink-permeable member 2 is bulged outwardly while sliding on the circumferential surfaces of the circular plate members 16 and when the depressing force is removed, the ink-permeable member returns to the original state by the spring 24.

Figure 5:
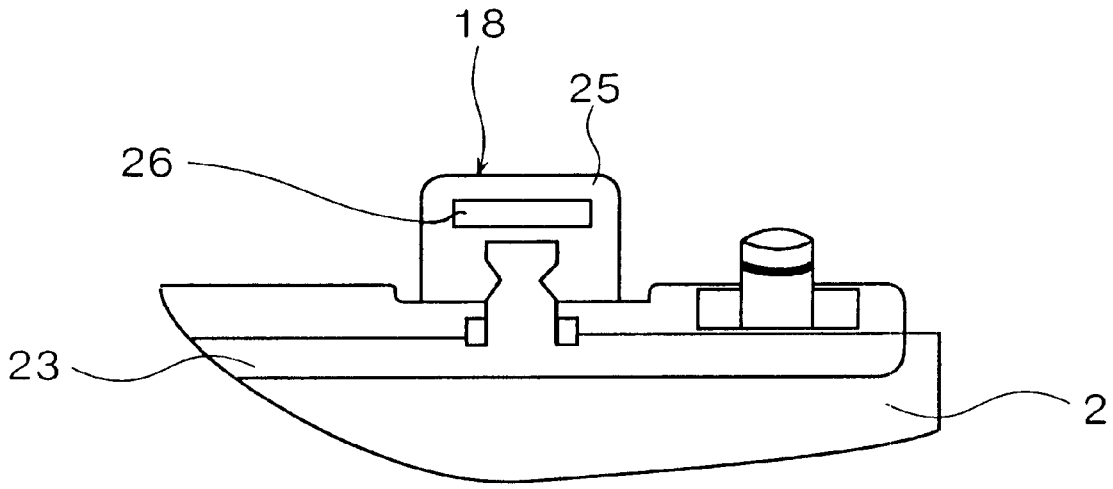
FIG. 5 is a view viewed from an arrow mark 5 of FIG. 2.

As shown by FIG. 2 and FIG. 5, an engaging portion 25 is formed at the other end portion of the clamp member 18. The engaging portion 25 is formed with a long hole 26 along the periphery of the drum 1. The spring 24 attached to the connecting plate 23 of the ink-permeable member 2, is movably engaged with the long hole 26 of the engaging portion 25. Therefore, when the one end portion side (upstream side) of the ink-permeable member 2 is moved by skew adjusting means, explained below, the other end portion side (downstream side) of the ink-permeable member 2 is moved relative to the base member 15.

According to the example, the ink-permeable member 2 which is made to wrap on the base member 15 is moved in a skewed direction which is not in parallel with both of the direction of the central axis line (transfer direction) and the rotational direction (longitudinal direction). An explanation will be given of skew adjusting means 30 (not shown) achieving the function.

Figure 3:
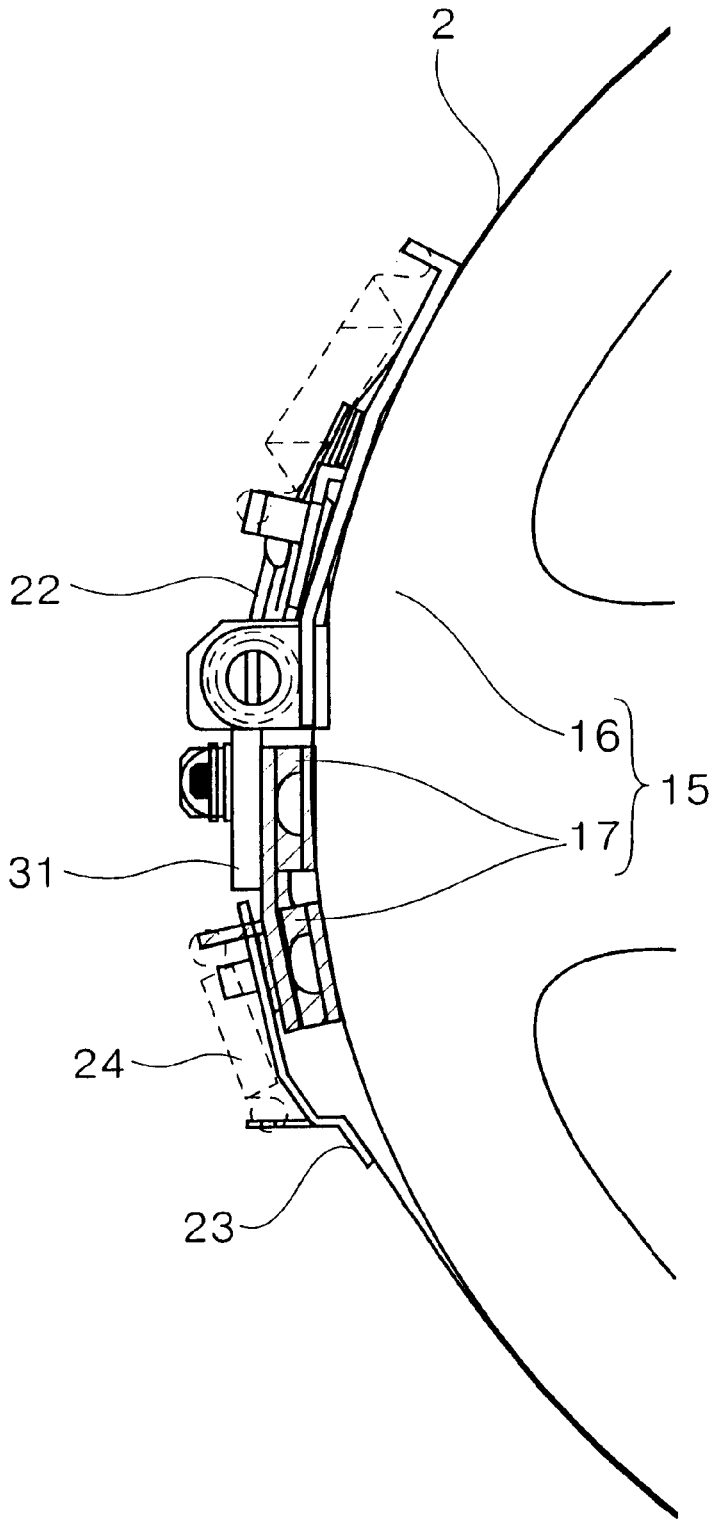
FIG. 3 is a right side view of the first example according to the present invention.
Figure 4:
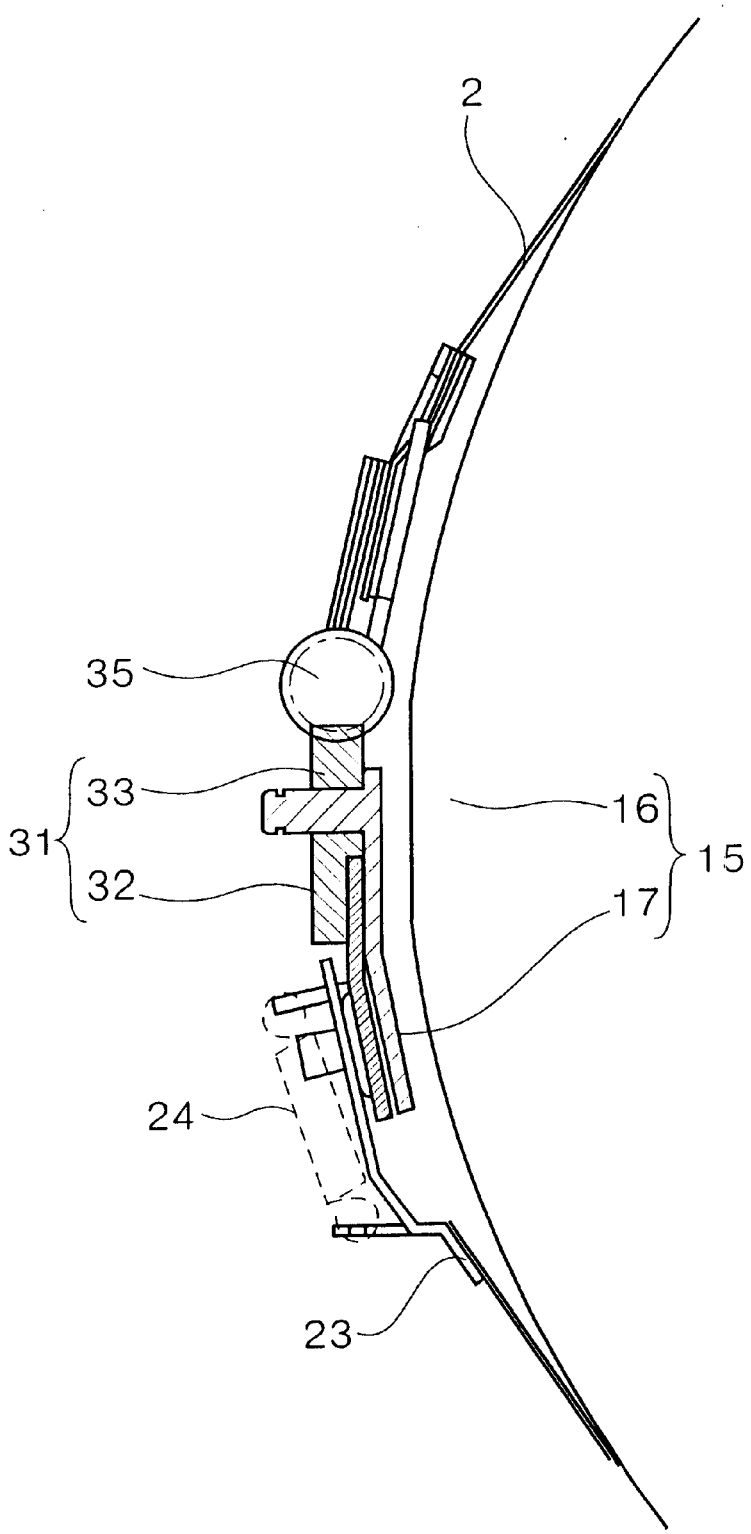
FIG. 4 is a sectional view taken along line 4—4 in FIG. 2.

As shown by FIGS. 2, 3 and 4, a cam 31 is axially supported by one end portion of the connecting base plate 17. The cam 31 is provided with a cam portion 32 and a gear portion 33. The cam portion 32 is provided with a stepped difference formed in the thickness direction and the stepped difference is engaged with a side edge portion of the clamp base plate 18. A spring 34 is provided between the clamp base plate 18 and the circular plate member 16 and urges the clamp base plate 18 to the cam portion 32. Therefore, rotation of the cam 31 smoothly moves the clamp base plate 18 with no play between the clamp base plate 18 and the cam portion 32. A moving gear 35 is provided to the circumferential surface of the circular plate member 16 via an attachment plate. The gear portion 33 of the cam 31 is engaged with the moving gear 35. The moving gear 35 is connected with a drive shaft, not illustrated, as driving means as necessary. When the printing drum 1 is stopped at a predetermined position, the drive shaft approaches in a direction designated by an arrow mark (c) in FIG. 2 and is connected to the moving gear 35. The clamp base plate 18 is axially supported at its central portion and accordingly, when the rotating cam 31 moves a side edge portion of the clamp base plate 18, the clamp base plate 18 is rotated centering on the fulcrum shaft 19. The ink-permeable member 2 attached to the clamp base plate 18 and the stencil sheet attached to the ink-permeable member 2 are moved in the skewed direction on the base member 15.

Next, an explanation will be given of operation in the above-described constitution.

Perforated stencil sheet is mounted to the printing drum 1. That is, the front end portion of the stencil sheet is fixed onto the clamp base plate 18 by the clamp plate 22 and the stencil sheet is made to wrap on the ink-permeable member 2 in accordance with rotation of the printing drum 1. Thereafter, printing operation is carried out as described above.

After carrying out the printing operation, when provided image is shifted in a skewed direction relative to the print sheet, position of the image is adjusted by using the skew adjusting means 30. By rotating the moving gear 35, the cam 31 in mesh with the moving gear 35 is rotated. As shown by an arrow mark (d) in FIG. 1, the clamp base plate 18 in contact with the cam 31 carries out circular motion centering on the fulcrum shaft 19. Thereby, the ink-permeable member 2 fixed to the clamp base plate 18 also carries out rotational motion centering on the fulcrum shaft 19. The perforated stencil sheet on the ink-permeable member 2 also carries out circular motion centering on the fulcrum shaft 19. As a result, the shift of the image in the skewed direction of the stencil sheet relative to the print sheet is adjusted. According to the example, the fulcrum shaft 19 of the clamp base plate 18 is disposed at the substantially central portion of the printing drum 1 in the central axis line direction and accordingly, reference in adjusting the image is clear and an adjustment width can be minimized. Further, in a normal case, an amount of moving the ink-permeable member in the skew adjustment, is about several millimeters at maximum in an amount of movement in the rotational direction at an end portion of the printing drum in the central axis line.

The ink-permeable member is made to wrap on the circular member 16 by the elastic force of the spring 24. Therefore, in the above-described skew adjustment, even when the upstream side in the rotational direction of the ink-permeable member is pivoted, the downstream side is not pivoted simultaneously. However, according to the structure of the example, when the one end portion side (upstream side) of the ink-permeable member 2 is pivoted, the connecting plate 23 on the other end portion side (down stream side) of the ink-permeable member 2 can be slid in the axial direction designated by an arrow mark (e) in FIG. 2. Therefore, unreasonable force is not exerted to the stencil sheet and wrinkle is not caused in the stencil sheet.

An explanation will be given of a second example of an embodiment according to the present invention in reference to FIG. 6 through FIG. 10.

As a whole, a constitution of a stencil printing machine according to the example is substantially the same as that in the first example. In the constitution of the printing drum 1 of the example, portions substantially the same as those of the first example in view of their functions are attached with notations the same as those in the first example and an explanation thereof will be omitted. In the following, an explanation will be given centering on skew adjusting means 40 for moving the ink-permeable member 2 in the skewed direction.

According to the example, on an inner face side of at least one circular plate member 41, a recess portion 42 in a shape of a fan is formed to open to an outer circumferential surface thereof. At the recess portion 42, there is provided a moving member 43 in a shape of a fan. The moving member 43 is pivotable around the central axis line of the base member 15. The side edge portion of the clamping base plate 18 is connected to an outer circumferential surface of the moving member 43. The moving member 43 connected with the clamping base plate 18 is pivoted by driving means.

As explanation will be given of driving means for moving the moving member 43.

Figure 8:
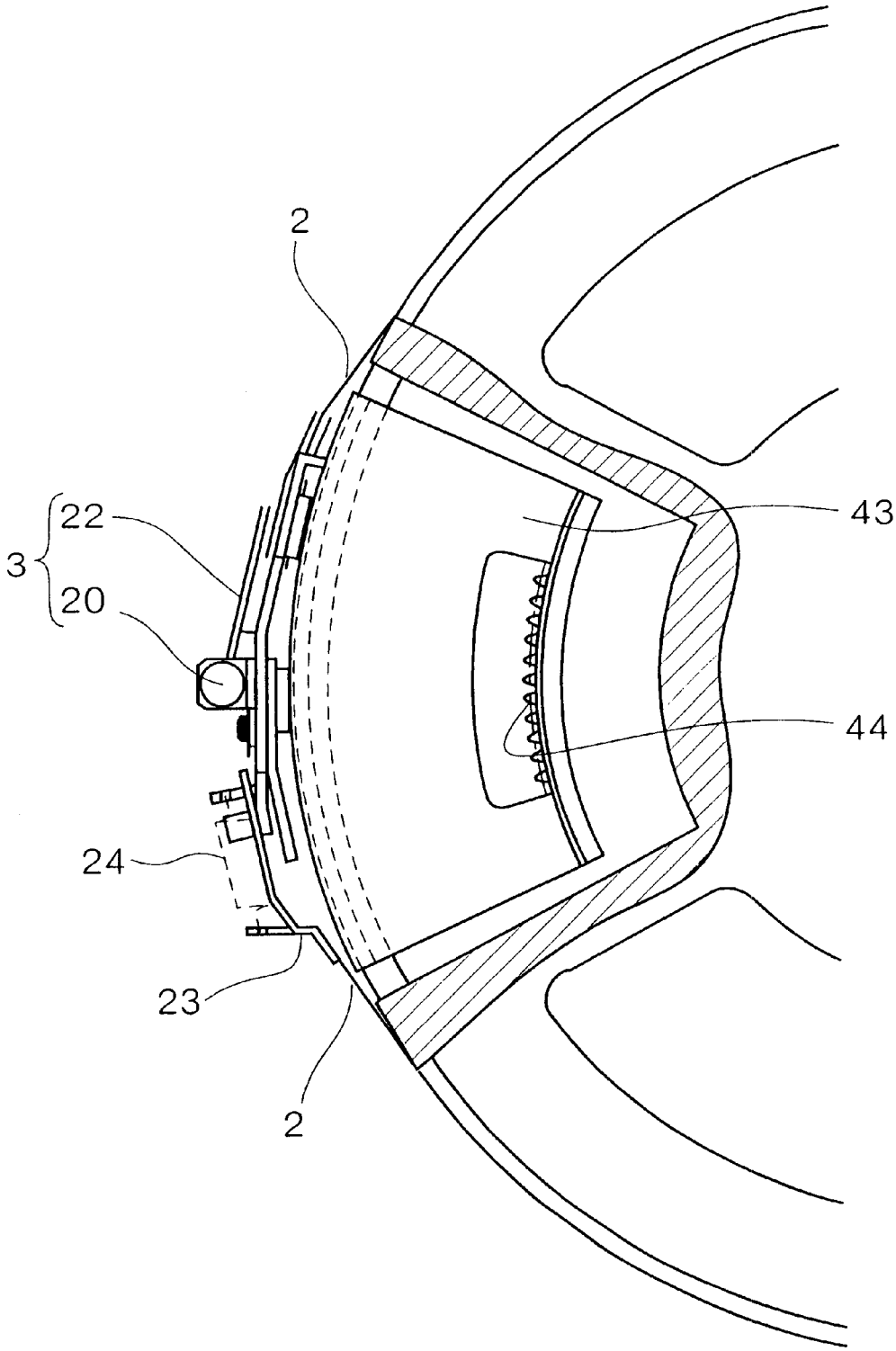
FIG. 8 is a right side view cutting a portion of the second example according to the present invention.
Figure 9:
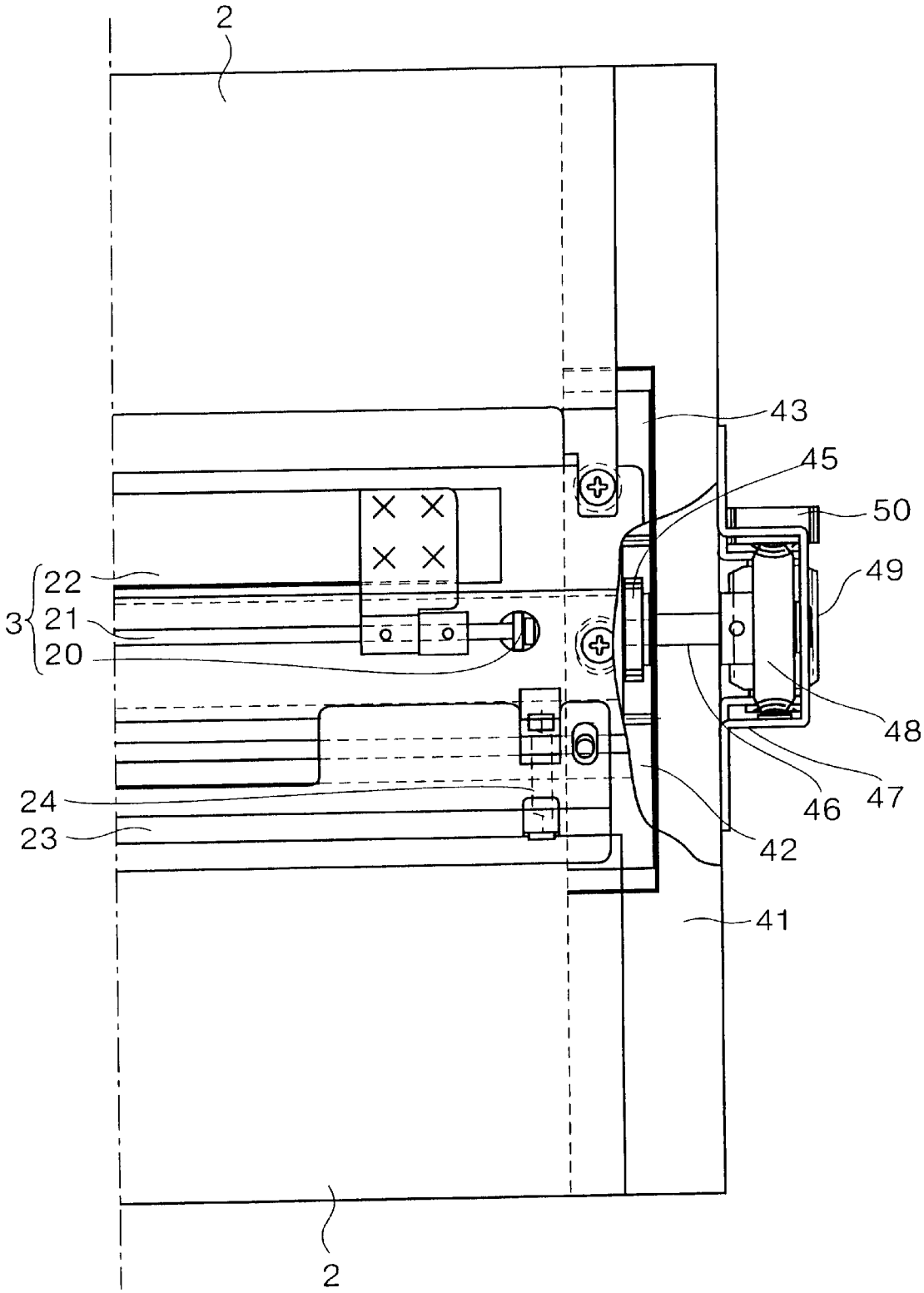
FIG. 9 shows a right half portion breaking a portion of the plan view of the second example according to the present invention.
Figure 10:
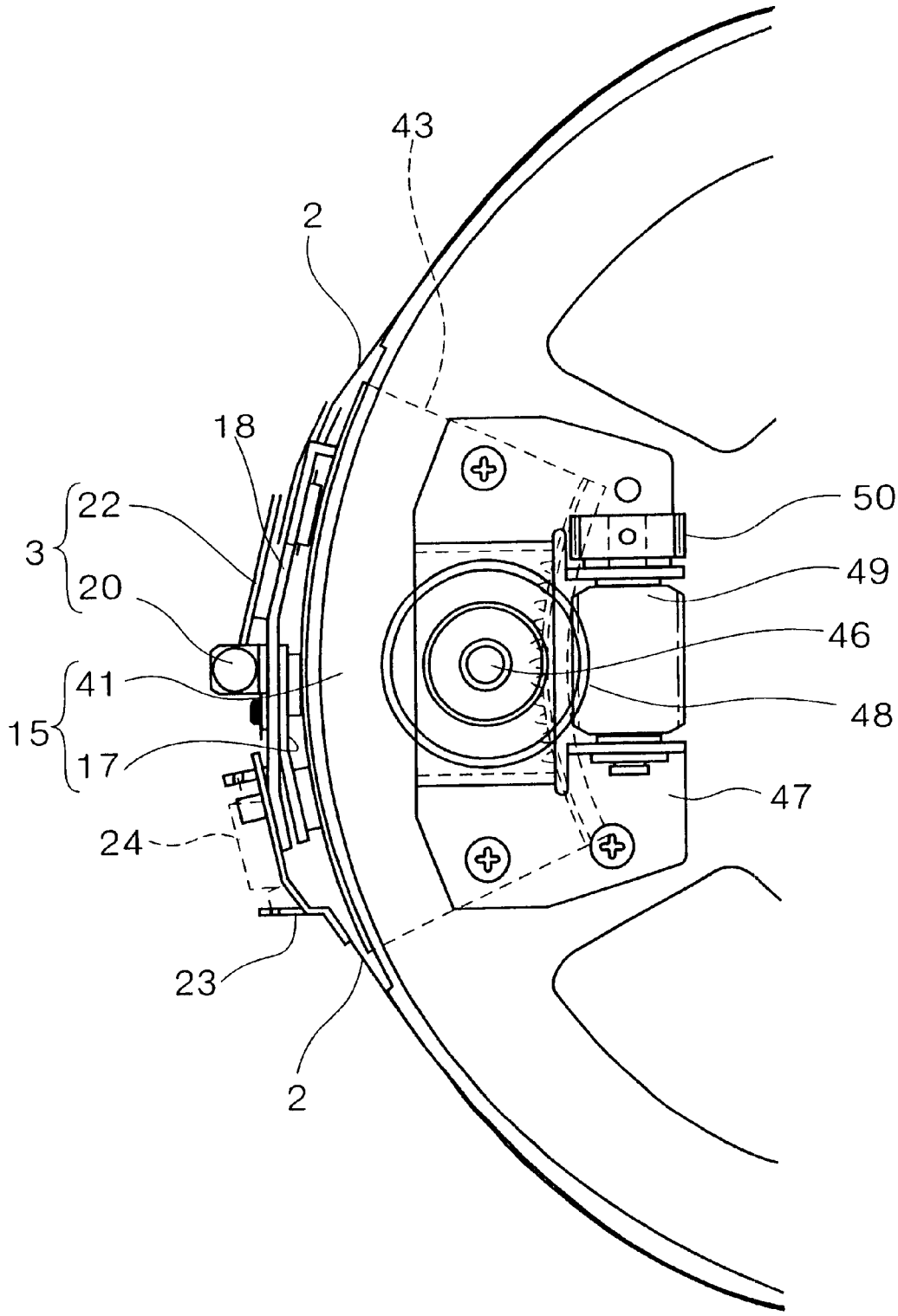
FIG. 10 is a right side view of the second example according to the present invention.

As shown by FIG. 8, a gear portion 44 is provided at a portion of the moving member 43. As shown by FIG. 9, the circular plate member 41 is arranged with a first drive gear 45 in mesh with the gear portion 44. A central shaft 46 of the first drive gear 45 penetrates the circular plate member 41 and is projected to outside. An end portion of the central shaft 46 disposed at outside of the circular plate member 41, is supported by a fixing sheet 47. On an inner side of the fixing sheet 47, the central shaft 46 is attached with a second drive gear 48. Further, the fixing sheet 47 rotatably holds a first transmission gear 49 in mesh with the second drive gear 48 and the first transmission gear 49 is coaxially provided with a second transmission gear 50. The second transmission gear 50 is connected with an outside drive source, not illustrated.

When image is adjusted, drive force of an adjusting motor, not illustrated in the drawing, is transmitted in an order of the second transmission gear 50, the first transmission gear 49, the second drive gear 48 and the first drive gear 45 to thereby move the moving member 43 in the circumferential direction of the circular plate member 41. As a result, a phase in the rotational direction between the circular plate member 41 and the moving member 43 with respect to the central axis line, is changed and a positional relationship between the connecting base plate 17 and the clamping base plate 18 fixed to the both members is also changed. In this case, the clamping base plate 18 is rotatably supported by the fulcrum shaft 19 of the connecting base plate 17 at its substantially central point thereof Therefore, the clamping base plate 18 carries out rotational motion centering on the fulcrum shaft 19 by a change in the phase between the moving member 43 and the circular plate member 41. The ink-permeable member 2 attached to the clamping base plate 18 and the stencil sheet attached thereto also carry out rotational motion centering on the fulcrum shaft 19. Thereby, the skew adjustment of image can be carried out.

Figure 6:
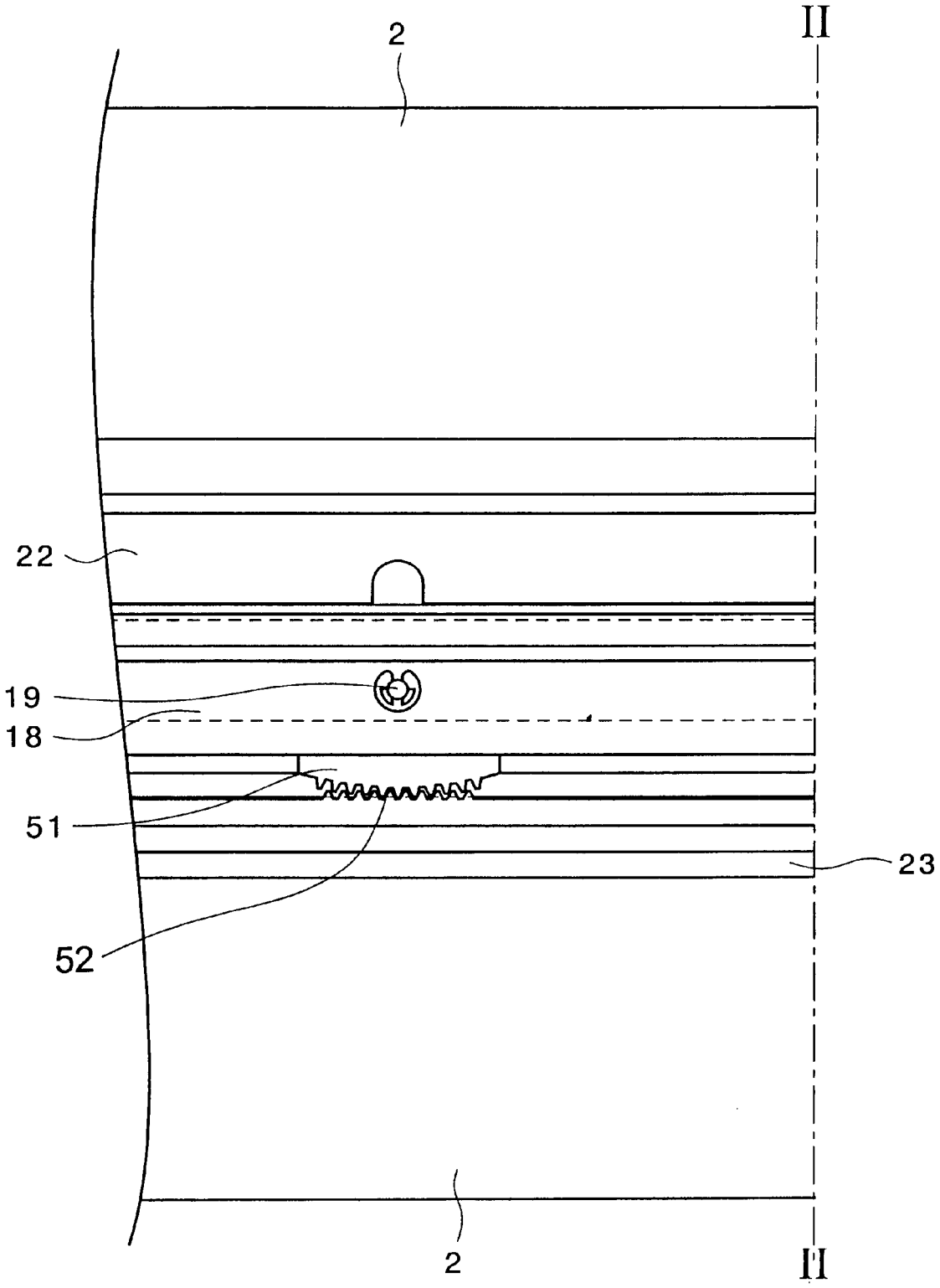
FIG. 6 shows a left half portion of a plan view of a second example according to the present invention.
Figure 7:
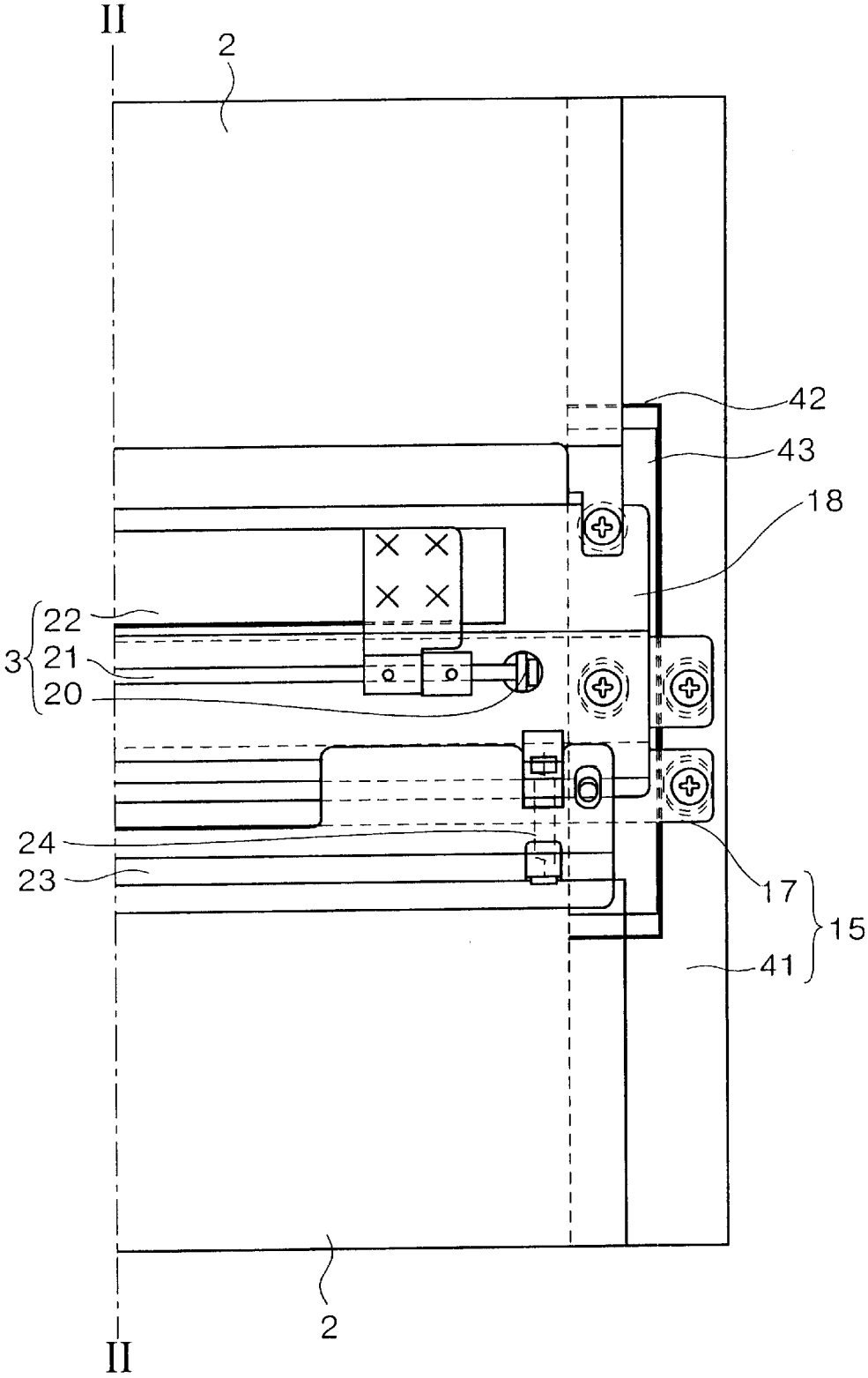
FIG. 7 shows a right half portion of the plan view of the second example according to the present invention.

According to the example, when the upstream side of the ink-permeable member 2 is moved in the skewed direction, in cooperation therewith, the downstream side of the ink-permeable member 2 is also moved in the skewed direction. Such an operation is achieved by the following mechanism. As shown by FIG. 6, a first gear portion 51 is formed at the other end portion of the clamping base plate 18. The first gear portion 51 is formed at proximity of the fulcrum shaft 19. Further, a second gear portion 52 is formed at the connecting plate 23 attached to the other end portion side of the ink-permeable member 2. The first gear portion 51 and the second gear portion 52 are in mesh with each other. Therefore, when the clamping base plate 18 is pivoted by the skew adjusting means 40, the connecting base plate 23 connected to the downstream side of the ink-permeable member 2 is also pivoted.

Figure 11:
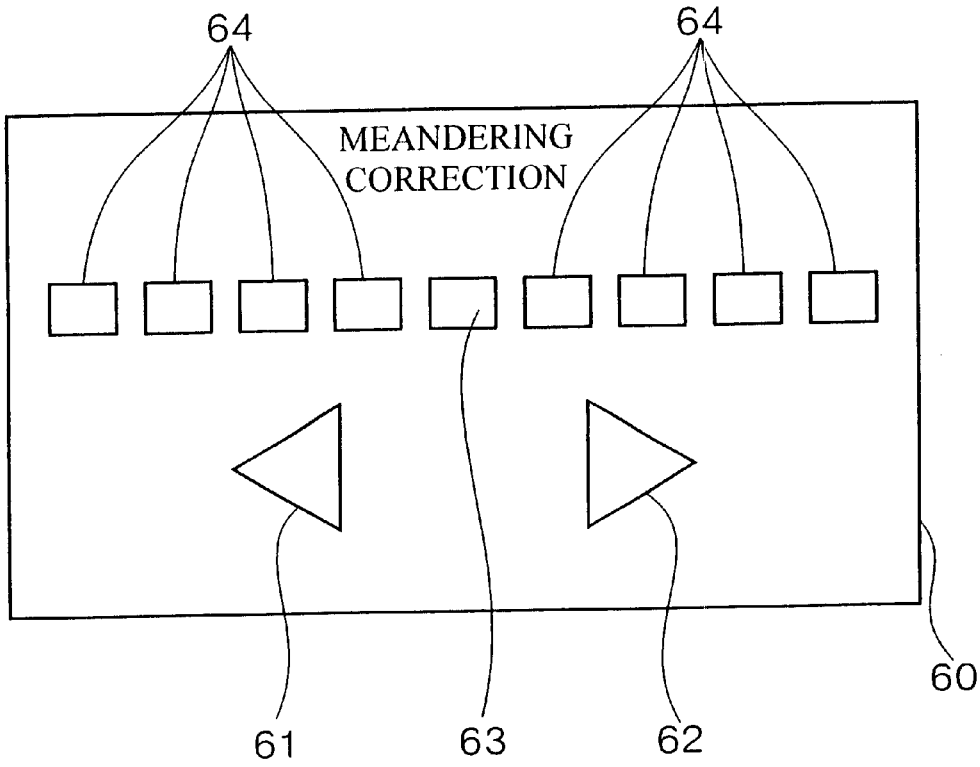
FIG. 11 is a view showing to enlarge a portion of a control panel in the examples according to the present invention.

FIG. 11 is an enlarged view of a control panel 60 applied to the above-described examples. At a portion of the control panel 60, there are provided two of direction switches 61 and 62 indicating the rotational direction of the ink-permeable member 2 in the skew adjustment (meandering correction). Further, there are also provided display elements 63 and 64 indicating an amount of rotating the ink-permeable member 2 in the skew adjustment (meandering correction). The display element 63 at the center indicates a correction amount of 0. The display elements 64 aligned respectively by fours on the left and on the right indicate correction amounts each of 0.4 mm per piece. The correction amount indicates a movement amount in the circumferential direction at the side edge portion of the ink-permeable member 2. Therefore, a maximum of 2 mm of correction can be carried out in each of the two rotation directions. When such operating means and displaying means are provided at the control panel 60 of the printing machine, the skew adjustment of the ink-permeable member 2 can simply be carried out.

Further, each of the moving gear 35 and the second transmission gear 50 in the above-described embodiments is in mesh with a drive gear attached to a drive shaft of a motor which is driving means, not illustrated. Further, when the direction switch 61 or 62 of the control panel 60 is depressed, the motor is driven and the screen member 2 is pivoted in accordance with an amount of driving the motor. Thereby, the skewed direction of the printed image formed at the print sheet can be adjusted.

Further, in the above-described embodiments, when printing operation is carried out by using successive newly perforated stencil sheet, it is necessary to peel off the stencil sheet which is made to wrap on the outer circumferential surface of the printing drum 1 by discharging means, not illustrated, and abandon the stencil sheet to a discharge box or the like, not illustrated. In that case, the stencil sheet is peeled off while rotating the printing drum and therefore, when the stencil sheet on the screen member is brought into a state of being inclined to the rotational direction of the printing drum, normal discharging processing cannot be carried out. Therefore, prior to the discharging operation, there is carried out a control of returning the screen member 2 to a home position which is an initially set position. In that case, lighting states of the display elements 63 and 64 on the control panel 60 are checked by the controlling means, not illustrated. When the display element 63 is not lighted, that is, when the skew adjustment of the printed image is carried out and any one of the display elements 64 is lighted, the screen member 2 is driven to turn to the home position by driving the motor. Further, as timing of returning the screen member 2 to the home position, time point at which new perforating instruction is inputted from an operation panel or the like is preferable. When the screen member 2 is returned to the home position in the discharge operation, one end portion of successive newly perforated stencil sheet can firmly be held by the clamping means 3 in a predetermined state.

The stencil printing machine of the above-described example is provided with the printing drum in which the ink-permeable member is made to wrap on the pair of connected circular plate members by the elastic force of the springs. According to the machine having such a constitution, printing operation is carried out by deforming the ink-permeable member outwardly and sandwiching print sheet between the ink-permeable member and the pressure drum at outside thereof. However, the present invention is not applied only to the stencil printing machine having such a basic constitution. The present invention is applicable also to a stencil printing machine having a rotatable base member having rigidity and an ink-permeable member which is made to wrap on the base member. The structure of the base member is not particularly limited. For example, a base member in a cylindrical shape made of metal may be used. In such a case, an ink-permeable opening area is formed at a peripheral wall thereof. The ink-permeable member is made to wrap around the cylindrical member made of metal.

According to the present invention, adjustment can be carried out even in the case in which printed image is printed obliquely and printed image having excellent image quality can be provided.

Further, according to the present invention, when both end portions of the ink-permeable member cooperate with each other, printing operation can be carried out without exerting unreasonable force to the printing drum 1 or the stencil sheet and accordingly, shift or the like of the stencil sheet can be prevented.

Further, according to the present invention, when there is constructed the constitution in which the ink-permeable member is pivoted by the cam provided to the circular plate member, there is no concern in which the skew adjusting means is brought into contact with and destructed by other printing member (pressure drum or the like) arranged outside of the printing drum.

Further, according to the present invention, when there is constructed the constitution in which the ink-permeable member is pivoted by the moving members pivoted coaxially with the circular plate member, essential portions of the skew adjusting means can be arranged on the side of the rotational center of the circular plate member and accordingly, inertia of the printing drum is reduced and a variation in load in operating the printing machine is reduced.

What is claim is:

1. A stencil printing machine comprising:

a base member for forming a cylindrical shape having rigidity and rotated around a central axis line of its own;

a clamp base plate pivotally attached to a portion for forming the cylindrical shape of the base member;

an ink-permeable member having one end portion fixed to the clamp base plate, a pair of side edge portions wrapped around the base member with respect to a rotational direction of the base member, and the other end portion opposite to the one end portion, said ink-permeable member being mounted to the base member along the rotational direction and forming a circumferential surface for attaching a stencil sheet; and skew adjusting means attached to the base member for moving the ink-permeable member relative to the base member in a skewed direction which is not parallel with both of the central axis line and the rotational direction.

2. The stencil printing machine according to claim 1, wherein the skew adjusting means moves a side of the one end portion of the ink-permeable member in the skewed direction.

3. The stencil printing machine according to claim 2, wherein the ink-permeable member is pivotable relative to the base member on a substantially central portion relative to the central axis line at the one end portion of the ink-permeable member.

4. The stencil printing machine according to claim 3, wherein the other end portion of the ink-permeable member is made movable around the base member.

5. The stencil printing machine according to claim 1, wherein the skew adjusting means moves the one end portion and the other end portion of the ink-permeable member in the skewed direction in cooperation with each other.

6. The stencil printing machine according to claim 1, wherein said base member includes a connecting base plate extending parallel to the central axis line, said clamp base plate being pivotally attached to a longitudinal center portion of the connecting base plate to change a direction thereof.

7. A stencil printing machine comprising:

a pair of circular plate members arranged coaxially on a common central axis line;

a first base member for connecting the pair of circular plate members and rotated around the central axis line;

a second base member attached pivotally to the first base member;

clamping means provided to the second base member;

an ink-permeable member having one end portion attached to one end portion of the second base member, a pair of side edge portions which are made to wrap on the pair of circular plate members along a rotational direction of the base member and the other end portion attached to the other end portion of the second base member and forming a circumferential surface for attaching a stencil sheet, one end portion of which is fixed to the clamping means; and skew adjusting means provided to the circular plate members for moving the ink-permeable member in a skewed direction which is not parallel with both of a central axis line and the rotational direction by pivoting the second base member relative to the first base member.

8. The stencil printing machine according to claim 7, further comprising:

an engaging portion formed at the other end portion of the second base member along the central axis line; and an elastic member for connecting the other end portion of the ink-permeable member to the engaging portion;

wherein when the second base member is moved in the skewed direction by the skew adjusting means, the other end portion of the ink-permeable member is moved along the central axis line.

9. A stencil printing machine comprising:

a pair of circular plate members arranged coaxially on a common central axis line;

a first base member for connecting the pair of circular plate members and rotated around the central axis line;

a second base member attached pivotally to the first member;

clamping means provided to the second base member;

an ink-permeable member having one end portion attached to one end portion of the second base member, a pair of side edge portions which are made to wrap on the pair of circular plate members along a rotational direction of the base member and the other end portion attached to the other end portion of the second base member and forming a circumferential surface for attaching a stencil sheet, one end portion of which is fixed to the clamping means; and skew adjusting means having a moving member provided to one of the circular plate members to be pivotable around the central axis line and connected with a side edge portion of the second base member for moving the ink-permeable member in a skewed direction which is not parallel with both of the central axis line and the rotational direction by pivoting the second base member relative to the first base member by moving the moving member.

10. The stencil printing machine according to claim 9, further comprising:

a first gear portion formed at the other end portion of the second base member: and a second gear portion provided on the other end portion of the ink-permeable member and engaged with the first gear portion;

wherein when the second base member is moved in the skewed direction by the skew adjusting means, the other end portion of the ink-permeable member is moved in the skewed direction.

* * * * *